United States Patent [19]

Reed et al.

[11] Patent Number: 4,970,934

[45] Date of Patent: Nov. 20, 1990

[54] DRUM STICK ORGANIZATION

[76] Inventors: Ric L. Reed, 6822 Gafford Dr.; Hollis B. Reed, Jr., 6216 Ambleside Dr.#C, both of Columbus, Ohio 43229

[21] Appl. No.: 509,630

[22] Filed: Apr. 16, 1990

[51] Int. Cl.[5] ..... G10D 13/02

[52] U.S. Cl. ..... 84/422.4

[58] Field of Search ..... 84/422.1, 422.4

[56] References Cited

U.S. PATENT DOCUMENTS

| | | | |
|---|---|---|---|
| 3,460,424 | 8/1969 | Tepper | 84/422.4 |
| 3,465,635 | 9/1969 | Maldacker | 84/422.4 |
| 3,688,013 | 8/1972 | Menard | 84/422.4 |
| 4,590,839 | 5/1986 | Liedtke | 84/422.4 |
| 4,651,617 | 3/1987 | Schwartz | 84/422.4 |

*Primary Examiner*—Brian W. Brown

*Attorney, Agent, or Firm*—Leon Gilden

[57] ABSTRACT

An apparatus is set forth including a central housing formed with a series of release buttons directed through an upper surface of the housing cooperating with grooves formed in forwardly extending drum sticks to selectively secure and release the drum sticks from the housing to vary the number of drum sticks secured by the housing to accordingly effect drum harmonics during play of a drum instrument. The organization further includes a longitudinally aligned, rearwardly extending handle formed with a thumb rest mounted thereon and a counter-weight positionable and mounted to a rear terminal end of the handle to accommodate and counter-balance the housing weight and varying drum stick weight, dependent on the number of drum sticks secured to the housing.

8 Claims, 4 Drawing Sheets

FIG 1
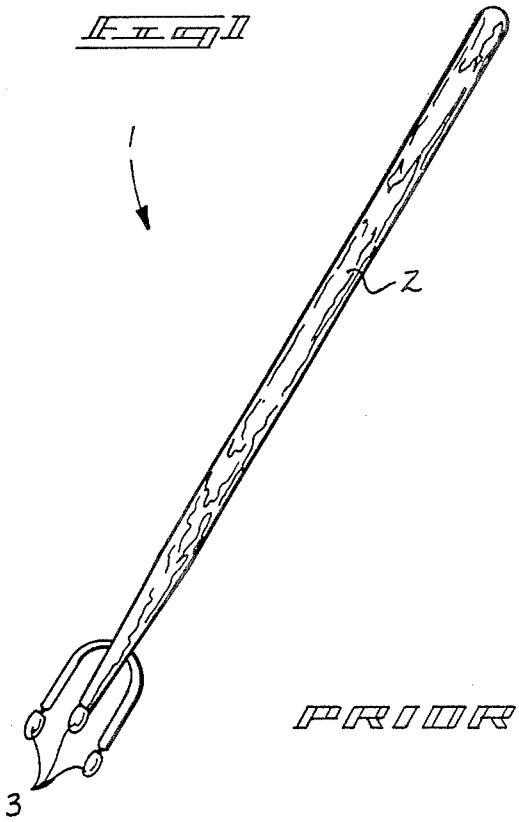
PRIOR ART
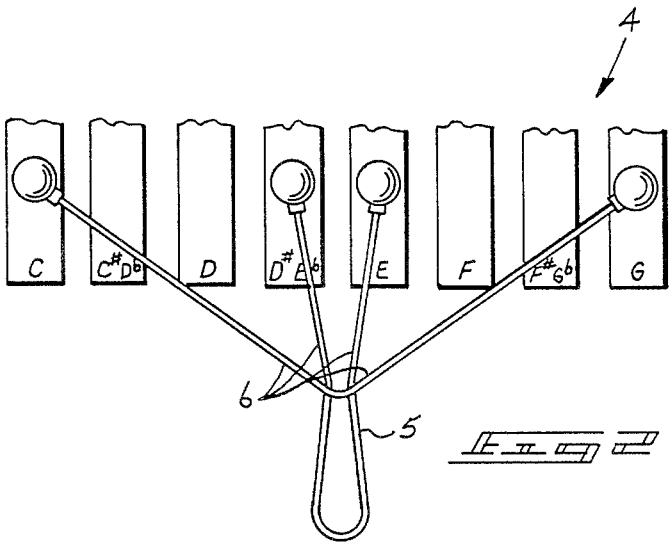
FIG 2
PRIOR ART

DRUM STICK ORGANIZATION

BACKGROUND OF THE INVENTION

1. Field of the Invention

The field of invention relates to drum stick instruments, and more particularly pertains to a new and improved drum stick organization wherein the same permits selective securement of a desired number of drum sticks securable to an associated housing to selectively alter drum harmonics.

2. Description of the Prior Art

Drum sticks of varying types and configurations are known in the prior art. The drum stick organizations of the prior art have typically utilized a fixed number of directed drum sticks mounted to the housing to effect predetermined drum harmonics in the application of a prior art drum stick member in the playing of a particular preselected drum instrument. Examples of the prior art include U.S. Pat. No. 3,688,013 to Menard wherein a drum stick includes a flexible element mounting a plurality of drum stick heads exteriorly of a central drum stick head. The organization is typical of prior art drum sticks utilizing a fixed number of drum sticks mounted to a handle member.

U.S. Pat. No. 3,465,635 to Maldacker wherein a mallet construction enables positioning of a plurality of heads to a handle, wherein the heads are mounted to an elaborate cross-bar organization inappropriate for drum stick application due to the cumbersome and expansive structure required.

U.S. Pat. No. 4,651,617 to Schwartz provides a drum striking instrument utilizing a pivotally attached second drum striking member mounted adjacent a forward portion of the handle to provide a multi-strike application in the playing of a drum instrument.

U.S. Pat. No. 4,590,839 to Liedtke, et al., provides a brush drum percussion device including a multi-headed fan-like member fixedly mounted to a handle.

U.S. Pat. No. 3,460,424 to Tepper includes a "U" shaped handle formed with a percussion striking head and at a forward end of each leg of the handle, with a further pair of legs directed at an acute angle relative to the handle directed forwardly thereof to mount a further pair of cord striking mallets.

As such, it may be appreciated to that there is a continuing need for a new and improved drum stick organization wherein the same addresses the problems of selective mounting of rigid drum striking rod members to a central support head to vary the cord and residence effected by the use of the organization and in this respect, the present invention substantially fulfills this need.

SUMMARY OF THE INVENTION

In view of the foregoing disadvantages inherent in the known types of drum striking members now present in the prior art, the present invention provides a drum striking organization wherein the same utilizes a single head member selectively mounting a desired series of drum sticks therewithin to selectively vary drum residence thereby. As such, the general purpose of the present invention, which will be described subsequently in greater detail, is to provide a new and improved drum stick organization which has all the advantages of the prior art drum striking structures and none of the disadvantages.

To attain this, the present invention provides an apparatus including a central housing formed with a series of release buttons directed through an upper surface of the housing cooperating with grooves formed in forwardly extending drum sticks to selectively secure and release the drum sticks from the housing to vary the number of drum sticks secured by the housing to accordingly effect drum harmonics during play of a drum instrument. The organization further includes a longitudinally aligned, rearwardly extending handle formed with a thumb rest mounted thereon and a counter-weight positionable and mounted to a rear terminal end of the handle to accommodate and counter-balance the housing weight and varying drum stick weight, dependent on the number of drum sticks secured to the housing.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claim appened thereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved drum stick organization which has all the advantages of the prior art drum stick striking structures and more of the disadvantages.

It is another object of the present invention to provide a new and improved drum stick organizations which may be easily and efficiently manufactured and marketed.

It is a further object of the present invention to provide a new and improved drum stick organizations which is of a durable and reliable construction.

An even further object of the present invention is to provide a new and improved drum stick organizations which is susceptible of a low cost of manufacture with regard to both materials and labor, and which accordingly is then susceptible of low prices of sale to the consuming public, thereby making such drum stick organizations economically available to the buying public.

Still yet another object of the present invention is to provide a new and improved drum stick organizations which provides in the apparatuses and methods of the prior art some of the advantages thereof, while simultaneously overcoming some of the disadvantages normally associated therewith.

Still another object of the present invention is to provide a new and improved drum stick organizations wherein the same addresses a need to vary drum striking residence and cord response by selectively varying a number of drum striking rods selectively secured to a central head.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art drum striking member.

FIG. 2 is a top orthographic view of a percussion striking mallet utilizing a fixed series of head members thereon.

DESCRIPTION OF THE PREFERRED EMBODIMENT

Figures 3, 4:
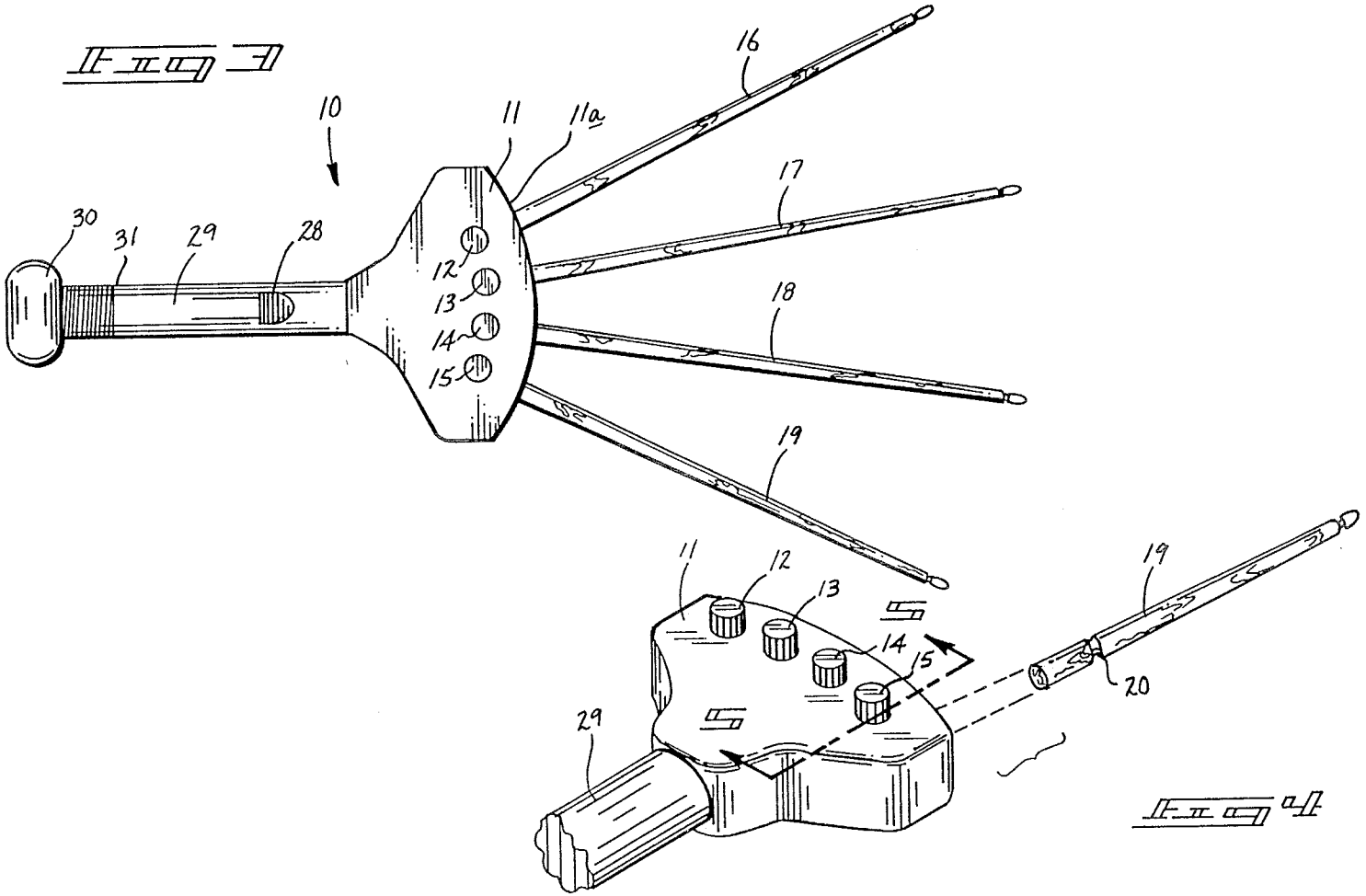
FIG. 3 is a top orthographic view of the instant invention.
FIG. 4 is a sectionalized symmetric illustration of the instant invention illustrating the head and an associated drum stick securable therewithin.

With reference now to the drawings, and in particular to FIGS. 1 to 9 thereof, a new and improved drum stick organization embodying the principles and concepts of the present invention and generally designated by the reference numeral 10 will be described.

FIG. 1 exemplifies a first prior art drum stick organization 1 comprising an elongate handle 2 mounting a central drum striker mounted medially of a pair of drum strikers fixedly secured to a forward end of a flexible "U" shaped bracket support. FIG. 2 is illustrates a further multi-strike member provided with a generally flexible wire "U" shaped handle 5 mounting a hammer mallet at each end of the leg of the "U" shaped member, with a further pair of legs defining forward leg members 6, each including a hammer mallet mounted at a forward end thereof.

More specifically, the drum stick organization 10 of the instant invention essentially comprises a central support head formed with an arcuate forward surface 11*a*, wherein the head reciprocatably mounted to a top surface thereof a first, second, third, and fourth release button 12, 13, 14, and 15 respectively. Each of the release buttons selectively secures a drum rod within the housing 11. The drum rods are indicated as a first drum rod 16, and second drum 17, a third drum rod 18, and a fourth drum rod 19, each selectively associated with the first through fourth release buttons 12 through 14. Each drum rod is formed of a rigid forwardly tapering member, wherein the tapering is directed to a reduced forwardly tapering end terminating in a respective striking cone. Each drum rod includes an encircling groove 20 formed coaxially of each drum rod adjacent a rear terminal end of each drum rod, as illustrated in FIG. 4 for example.

Figure 5:
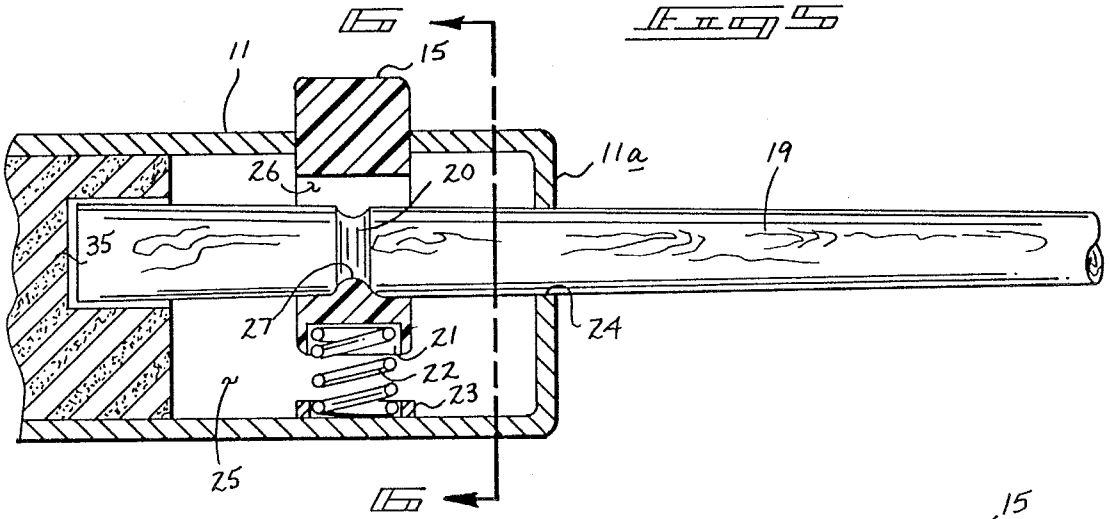
FIG. 5 is an orthographic view taken along the lines 5—5 of FIG. 4 in the direction indicated by the arrows.
Figure 6:
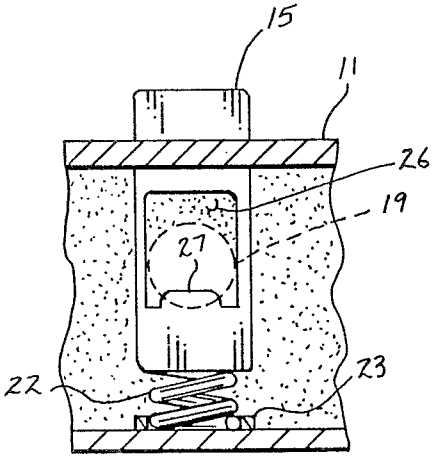
FIG. 6 is an orthographic view taken along the lines 6—6 of FIG. 5 in the direction indicated by the arrows.

Reference to FIGS. 5 and 6 illustrate each of the release buttons 12 through 15 of identical construction, wherein the fourth release button 15 is illustrated for purposes of detail. Each of the release buttons is mounted reciprocatably within a housing cavity 25 formed within the housing 11 at a forwardmost end thereof, as illustrated in FIG. 5 for example. Each of the release buttons is of a generally unitary cylindrical configuration, with a coaxially aligned cylindrical cavity 21 formed through a bottom surface thereof to receive an associated compression spring 22 therewithin. The upper end of the compression spring 22 is received and secured within the cylindrical cavity 21, with a lower end of the compression spring mounted within an associated spring cup 23 coaxially aligned with an associated release button, as illustrated in FIG. 6 for example. Each release button is formed with a through-extending button bore 26 of a generally rectangular, cross-sectional configuration, with a projection 27 directed upwardly from a floor of the button bore receivable within the groove 20 when the release button is in a raised position and disengaged from the groove 20 when the release button is in a depressed lowered position. It should also be noted that each associated drum rod 16 through 19 is received through the forward arcuate face 11*a* of the housing 11 through an associated rod bore 24 to align the drum rod within the housing 11 as it is directed through the release button and with a terminal end received within an alignment bore 35 coaxially aligned with the button bore 26 and the rod bore 24.

Figure 7:
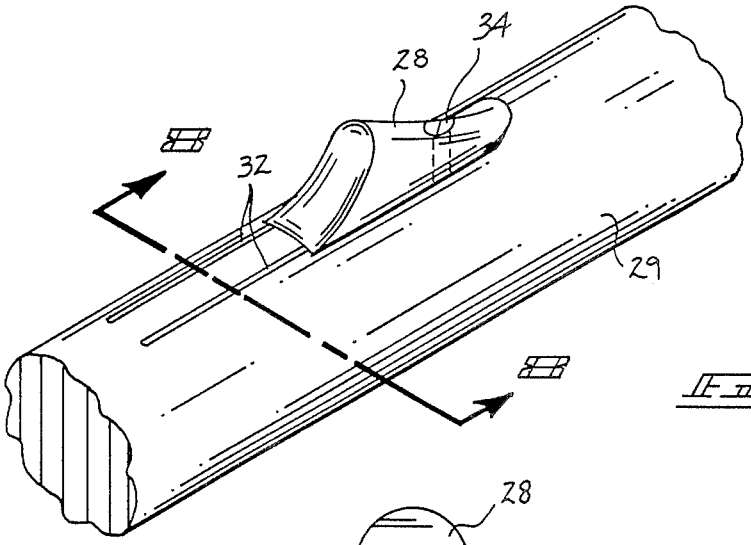
FIG. 7 is an isometric illustration of the thumb rest mounted to the handle of the invention.
Figure 8:
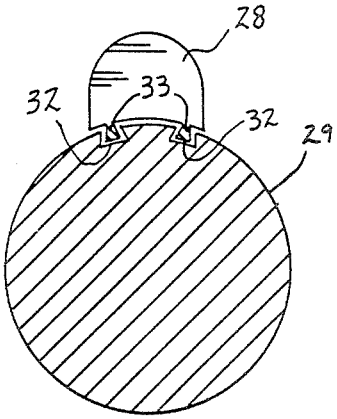
FIG. 8 is an orthographic view taken along the lines 8—8 of FIG. 7 in the direction indicated by the arrows.

Reference to FIG. 7 illustrates the thumb projection 28 mounted to the handle 29. The handle 29 is formed with a pair of spaced trapezoidal grooves 32 receiving a like pair of spaced trapezoidal projections 33 of a complementary cross-sectional configuration to that of the trapezoidal grooves 32 and spaced a like distance apart and fixedly mounted to a bottom surface of the thumb projection 28. A lock screw 34 is threadedly received within a forward sloping surface of the thumb projection 28 and imposes upon an upper surface of the cylindrical handle 29 to lock the thumb projection 28 in a preselected position axially along the surface of the handle 29, as illustrated.

Figure 9:
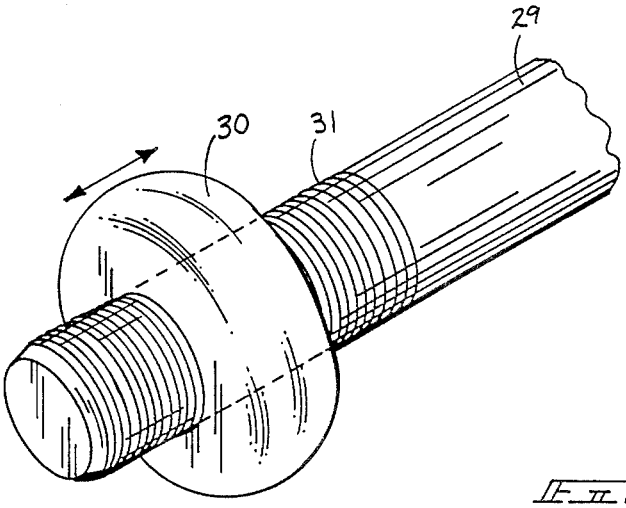
FIG. 9 is a sectional isometric illustration of the counter-weight axially adjustable relative to the handle of the instant invention.

FIG. 9 illustrates the doughnut shaped counter-weight 30 formed with internal threads to cooperate with external threads 31 mounted on a rear terminal end of the handle 29. The internal threads of the counter-weight 30 are of a slight interference fit with the handle threads 31 to selectively position the counter-weight 30 coaxially along the handle 29 to provide a counter-weight as desired, dependent upon the number of drum rods mounted within the support head 11.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A drum stick apparatus comprising, a predetermined number of drum sticks, and a support head means for releasably and selectively mounting the predetermined number of drum sticks therewithin, and an elongate, longitudinally aligned handle extending rearwardly and medially of a rear surface of the support head means.

2. An apparatus as set forth in claim 1 wherein the support head means includes an arcuate forward surface spaced from the rear surface, and the predetermined number of drum sticks are slidably received within a respective rod bore formed within the forward surface.

3. An apparatus as set forth in claim 2 wherein the support head means further includes a predetermined number of reciprocatable release members, each release member reciprocatably mounted through a top surface in said support head means, and each release member formed of a generally cylindrical body, and further including a cylindrical cavity formed within a bottom surface of each release member, and spring member including an upper end received within the cylindrical cavity, and the support head means including a bottom wall, and a lower end of the spring member received within a cup member mounted to a top surface of the bottom wall normally biasing the release button upwardly.

4. An apparatus as set forth in claim 3 wherein the release button includes a through-extending button bore receiving one of said predetermined number of drum sticks therethrough, the button bore of a generally rectangular configuration formed with a projection integrally formed to a bottom surface of the button bore, and each of the predetermined number of drum sticks including an annular groove circumferentially formed through an outer surface of each of the predetermined number of drum sticks and formed adjacent a rear end of each of the predetermined number of drum sticks, and the projection selectively received within the annular groove when the button is in a raised position and wherein the projection is directed exteriorly of the groove when the button is in a lowered position.

5. An apparatus as set forth in claim 4 wherein the support head means includes a cavity mounting each of the release buttons therewithin, and an interior surface of the support head means including a support bore, the support bore coaxially aligned with the button bore and the rod bore.

6. An apparatus as set forth in claim 5 wherein the handle includes an upwardly projecting thumb rest formed with an arcuate forward surface and a forwardly sloping rear surface, and a lock screw directed through the rear surface to lock the upwardly projecting thumb rest to the handle.

7. An apparatus as set forth in claim 6 wherein the upwardly projecting thumb rest includes a bottom arcuate surface, and wherein the bottom arcuate surface includes a spaced pair of trapezoidal projections receivable within a spaced pair of trapezoidal grooves, wherein the trapezoidal grooves receive the trapezoidal projections complementarily therewithin to enable the upwardly projecting thumb rest for adjustment coaxially spaced along an outer surface of the handle.

8. An apparatus as set forth in claim 7 wherein the handle includes an externally threaded rear surface, and an internally threaded doughnut shaped counter-weight including internal threads to effect an interference connection with the external threads of the handle to selectively and coaxially reposition the counter-weight along the handle.

* * * * *